US006187076B1

(12) United States Patent
Sugahara et al.

(10) Patent No.: US 6,187,076 B1
(45) Date of Patent: Feb. 13, 2001

(54) FLUIDIZED BED REDUCTION METHOD, FLUIDIZED BED REDUCTION REACTOR, AND FLUIDIZED BED REDUCTION SYSTEM

(75) Inventors: Takayuki Sugahara, Kobe; Ryoichi Hata, Osaka; Shintaro Ano, Osaka; Kenji Ohiraki, Osaka, all of (JP); Gilbert Yould Whitten, Jr., Charlotte, NC (US)

(73) Assignees: Kabushiki Kaisha Kobe Seiko Sho, Kobe (JP); Midrex Corporation, Charlotte, NC (US)

( * ) Notice: Under 35 U.S.C. 154(b), the term of this patent shall be extended for 0 days.

(21) Appl. No.: 08/785,693

(22) Filed: Jan. 17, 1997

(51) Int. Cl.[7] ..... C21B 13/00

(52) U.S. Cl. ..... 75/379; 75/414; 75/451; 266/172

(58) Field of Search ..... 266/172; 422/142; 75/444, 445, 446, 447, 448, 449, 450, 451, 379, 414

(56) References Cited

U.S. PATENT DOCUMENTS 3,140,940 * 7/1964 Keith ..... 75/451
4,224,056 * 9/1980 Tomizawa et al. ..... 75/448
5,531,424 7/1996 Whipp .

FOREIGN PATENT DOCUMENTS

755959 * 8/1956 (GB) ..... 422/142
53-47046 * 12/1978 (JP) ..... 75/451

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A fluidized bed reduction method in which powder raw material, including powder ore or partially pre-reduced powder ore, forms a fluidized bed with, and is sequentially reduced by reducing gas while being moved between a plurality of fluidized bed chambers; and to a fluidized bed reduction reactor which can be used in the same method. The movement of the powder ore between the fluidized bed chambers is carried out giving priority to relatively larger powder particles with the aim of improving the stability of the fluidized bed in the fluidized bed chambers. The adjustment of the reducing power of each fluidized bed chamber is made possible by introducing the reducing gas into the fluidized bed chambers in parallel, whereby an increase in the degree of reduction of the raw material can be realised.

20 Claims, 5 Drawing Sheets

FLUIDIZED BED REDUCTION METHOD, FLUIDIZED BED REDUCTION REACTOR, AND FLUIDIZED BED REDUCTION SYSTEM

THE BACKGROUND OF THE INVENTION

This invention relates to a fluidized bed reduction method used in the reduction of powder raw materials including powder ore or partially pre-reduced powder ore, and a fluidized bed reduction reactor and fluidized bed reduction system which can be used in the fluidized bed reduction method.

Fluidized bed reduction methods have been used conventionally as methods for reducing powder raw materials including powder ore or partially pre-reduced powder ore, and there exists many prior patents and publications disclosing the same, such as U.S. Pat. Nos. 5,118,479, 5,382,277, 5,431,711, 5,529,291 Japanese Patent No. 2536339, Japanese Patent No. 2536641, and a pamphlet published in 1987 by Fior de Venezuela, S. A.

Amongst the systems used in these fluidized bed reduction methods, several systems have been proposed with respect to reactors inside of which the powder raw material is made to form a fluidized bed and reduced. The first fluidized bed reduction methods involved securely maintaining a fluidized bed formed inside a single chamber, and carrying out reduction in this position. However, in recent years, the focus has been on systems in which the aim is to sequentially move the fluidized bed in line with the increase in degree of reduction, and carry out reduction efficiently in step with this movement. Such a system is disclosed in, for example, U.S. Pat. No. 5,118,479, in which, as shown in FIG. 1, there are arranged a plurality of guide plates for directing the movement of the fluidized bed in a single chamber in a zig-zag manner. In the pamphlet published by Fior de Venezuela, S. A. in 1987, there is disclosed a system in which a plurality of fluidized bed chambers are used, and in which the powder ore is reduced in each fluidized bed chamber whilst being moved between fluidized bed chambers.

With the reactor of the type shown in FIG. 1, powder ore A is introduced into fluidized bed chamber 1 from inlet 2, and forms a fluidized bed with the reducing gas introduced from reducing gas inlet 3 whilst moving in a zig-zag manner along guide plates 4, 5, 6, 7. The reduced powder B is removed from outlet 8. The temperature of the fluidized bed when effecting this system is usually set to be 700° C. or more. At these kinds of temperatures, the guide plates 4, 5, 6, 7 deform through thermal expansion, making it difficult to stably maintain the guide plates in an upright state. If the guide plates 4, 5, 6, 7 are not maintained in an upright state, this can have a bad effect on the state of the moving fluidized bed. Furthermore, in order to increase the reducing power, it is necessary to enlarge the fluidized bed chamber 1 and increase the number of guide plates in order to make the distance of movement of the fluidized bed inside the reactor sufficiently long. In such a case, in addition to the problem of the deformation of the guide plates, there is the fear that as the reducing gas inlet 3 and support components are enlarged, the bad effects of thermal expansion will increase all the more causing other problems with respect to the pressure-resistance, airtightness etc.

FIG. 2 shows a generalized view of a reactor in which several fluidized bed chambers are employed, and the reduction reaction is carried out sequentially in each fluidized bed chamber, as the powder ore is moved between fluidized bed chambers. Powder ore A is introduced from inlet 9 into the first fluidized bed chamber 13*a*, and moves along connection passages (16*a*, 16*b*) whilst forming a fluidized bed in each of the fluidized bed chambers (13*a*, 13*b*, 13*c*). The reduced powder B is removed from the last fluidized bed chamber 13*c* via outlet 17. The reducing gas is first introduced into the last fluidized bed chamber 13*c* from reducing gas inlet 14. Thereafter, it is exhausted from above the fluidized bed in fluidized bed chamber 13*c*, and introduced via reducing gas line 15*a* into the fluidized bed chamber 13*b* which comes one before it in the direction of the movement of the fluidized bed. Similarly, thereafter, the reducing gas which has been used in the fluidized bed chamber 13*b* is introduced into the fluidized bed chamber 13*a* via reducing gas line 15*b*. The reducing gas which has been used in the first fluidized bed chamber is exhausted via gas exhaust line 10. With this kind of system, the above-described deformation problems tend not to occur. Furthermore, since it is possible to meet the desired degree of reduction by increasing or reducing the number of fluidized bed chambers, those problems with respect to pressure-resistance and airtightness which can be associated with enlargement of the fluidized bed chamber (13*a*, 13*b*, 13*c*) also tend not to occur. In addition, since the system involves a construction in which the fluidized bed chambers are connected in series with respect to the flow of the reducing gas, the efficiency of use of the reducing gas is high. However, since the reactor system is constructed such that powder ore which has overflowed from the surface of the fluidized bed in each fluidized bed chamber moves to the next fluidized bed chamber, there is the problem that whereas relatively fine powder is easily moved, relatively large powder particles tend to sink to the bottom of the fluidized bed with the result that they tend to become trapped in a single fluidized bed chamber. This would not be such a big problem if the relatively large trapped powder particles would become suitably reduced, and if they would degenerate into fine powder in the fluidized chamber during the time that they are trapped and then sequentially move through the series of fluidized bed chambers. However, there exists a large difference in the extent of reduction between trapped material and material which moves smoothly, with the result that the smoothness of the reduction reaction is lost, and in some cases, successively trapped large powder particles collect in the bottom of the fluidized bed, which has a bad effect on the movement of the fluidized bed and on the flow of the reducing gas. If this occurs, then the load on the particular fluidized bed chamber in which it occurs increases compared to other fluidized bed chambers. Furthermore, since the reducing gas is caused to flow in series, there is the fear that there will also be a bad effect on the reducing efficiency of the system as a whole. Furthermore, with this kind of system, the reduced powder material is removed without exception from the outlet 17 of the last fluidized bed chamber 13*c*. This is unavoidable in order to obtain material having a sufficiently high degree of reduction, due to the fact that the reducing power of the reducing gas used in the last fluidized bed chamber is the greatest. However, it may occur that the powder has attained the prescribed degree of reduction before reaching the last fluidized bed chamber 13*c*, but due to the fact that the construction does not allow the removal of the ore before the last fluidized chamber 13*c*, the powder has to be passed without exception to the last fluidized chamber 13*c* which is not very efficient in terms of time and operation.

SUMMARY OF THE INVENTION

It is an object of the present invention to provide a fluidized bed reduction method with which, when using the kind of fluidized bed movement system described above, reduction can be carried out stably by the effective prevention of the phenomenon of relatively large powder particles becoming trapped in a fluidized bed chamber, and to provide a fluidized bed reduction reactor which can be used in the same method.

It is another object of the present invention to provide a fluidized bed reduction system with which the degree of reduction of the raw material can be increased, and to provide a fluidized bed reduction reactor which can be used in the same method.

It is still another object of the present invention to provide a fluidized bed reduction method with which the effects of deformation of the reduction reactor due to thermal expansion, and reduction in pressure-resistance and airtightness can be reduced, and to provide a fluidized bed reduction reactor which can be used in the same method.

It is yet still another object of the present invention to provide a fluidized bed reduction method with which it is possible to efficiently remove reduced powder material from the reactor when the raw powder material has attained the prescribed degree of reduction, and to provide a fluidized bed reduction reactor which can be used in the same method.

A fluidized bed reduction method of the present invention is one in which powder raw material, including powder ore or partially pre-reduced powder ore, is made to form a fluidized bed with, and sequentially reduced by reducing gas, whilst moving the powder raw material between a plurality of fluidized bed chambers, characterized in that the movement of the powder raw material between the fluidized bed chambers is carried out giving priority to relatively larger powder raw material in order to achieve a stable fluidized bed in each fluidized bed chamber.

More specifically, it is a fluidized bed reduction method in which powder raw material, including powder ore or partially pre-reduced ore, is made to form a fluidized bed with, and sequentially reduced by reducing gas, whilst moving the powder raw material between a plurality of fluidized bed chambers, characterized in that the movement of the powder raw material between the fluidized bed chambers is carried out at a position deeper than the surface of the fluidized bed in order to achieve a stable fluidized bed in each chamber. It is even more effective if the movement of the powder raw material between fluidized bed chambers is carried out at a position deep in the fluidized bed.

In this way, balanced and stable fluidized beds are formed, with a resulting improvement in the passage of the reducing gas through each fluidized bed. This makes it possible to stabilize the supply of reducing gas in the counter flow system of the kind shown in FIG. 2. It is however preferable to supply the reducing gas to each of the fluidized bed chambers in parallel, whereby the flow of the gas through the fluidized bed chambers can be yet further improved. Furthermore, with this method, the flow of gas can be controlled independently for each fluidized bed chamber, which makes the method of the present invention all the more effective. Furthermore, it is also very effective to control the pressure in the space formed above the fluidized bed inside each fluidized bed chamber.

Furthermore, it is also preferable to arrange that the raw powder material is moved in a circular direction between fluidized bed chambers arranged in a horizontal plane. It is also preferable to conduct the method so that powder raw material moving between fluidized bed chambers can be removed from an arbitrary fluidized bed chamber in accordance with the prescribed degree of reduction.

Furthermore, in another preferred embodiment of the present invention, the reducing gas exhausted from above the fluidized bed of each fluidized bed chamber according to the fluidized bed reduction method described above is introduced into a pre-reduction reactor to effect the pre-reduction of powder ore, and the thus pre-reduced powder ore is used as the powder raw material.

The fluidized bed reduction reactor of the present invention which can be used in the above-described fluidized bed reduction method has a plurality of cylindrical fluidized bed chambers connected in the direction of the movement of the powder raw material, including powder ore or pre-reduced powder ore, an inlet for the introduction of powder ore provided in the fluidized bed chamber which comes first in line in the direction of movement, an outlet for the removal of the reduced products of the powder ore provided in the last fluidized bed chamber, and a gas inlet connected via a gas dispersion plate to the bottom of the fluidized bed chambers, and is characterized in that the connection passage is provided in the fluidized bed chamber walls at a position deeper than the surface of the fluidized bed formed inside the fluidized bed chambers. It is preferred that the connection passage is provided in the fluidized bed chamber walls at a position deep in the fluidized bed.

Furthermore, it is preferred that gas inlet lines are connected to each fluidized bed chamber in parallel. It is also effective to provide a valve in each gas inlet line for adjusting the flow rate of the gas. Furthermore, it is yet further effective to provide in the gas exhaust line of each fluidized bed chamber means for controlling the pressure in the space above the fluidized bed.

Furthermore, it is preferred that each fluidized bed chamber has a cross-section which is generally circular or generally triangular in shape. It is also preferred that the fluidized bed chambers are arranged circularly in a horizontal plane. It is even further preferred that the gas dispersion plate of each fluidized gas chamber has a spherical surface shape.

In another preferred embodiment of the present invention, the number of fluidized bed chambers is three or more, and an outlet is provided in each of the plurality of fluidized bed chambers other than the fluidized chamber coming first in line in the direction of movement of the powder raw material.

It is also possible to provide a pre-reduction furnace together with the fluidized bed reduction reactor described above, connect the reducing gas outlet at the top of each fluidized bed chamber to the gas inlet of the pre-reduction furnace, and provide a raw material feed pipe for introducing the pre-reduced raw material removed from the pre-reduction furnace to the most upstream fluidized bed chamber of the above-described fluidized bed reduction reactor. It is preferred that the pre-reduction furnace is provided above the fluidized bed reduction reactor. In a preferred embodiment, the fluidized bed chambers are arranged circularly in a horizontal plane, a single vertical space is provided at the center of the circular arrangement, the upper part of this vertical space is adopted as the reducing gas exhaust section, and this exhaust section is connected to the gas inlet of the pre-reduction furnace.

BRIEF DESCRIPTION OF THE DRAWINGS

FIG. 1 is a generalized view of the kind of fluidized bed reduction reactor used in the prior art having guide plates provided therein.

DETAILED DESCRIPTION OF THE PREFERRED EMBODIMENTS OF THE INVENTION

Figure 3:
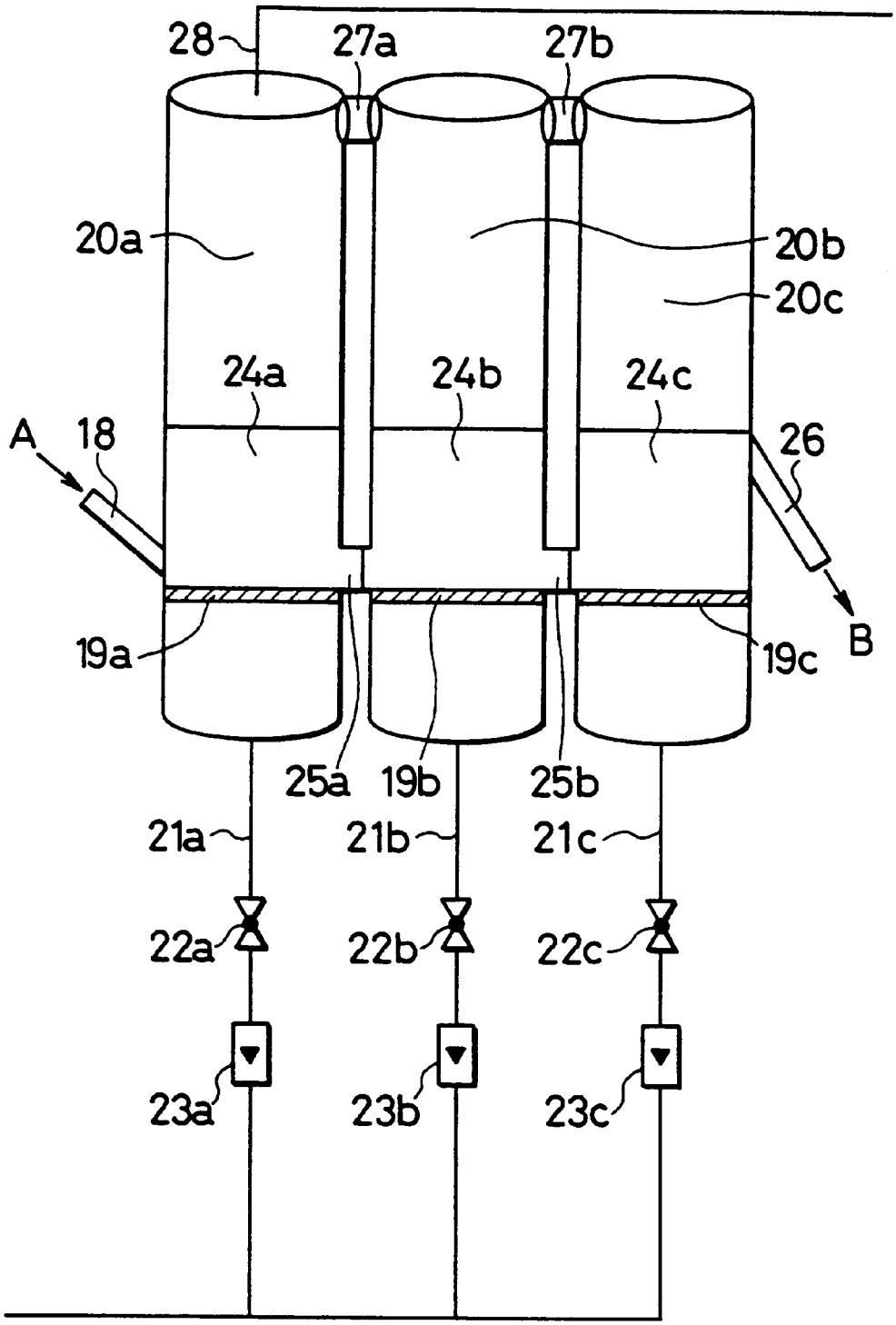
FIG. 3 is a generalized view of one example of the fluidized bed reduction reactor of the present invention used in an embodiment.

First, FIG. 3 will be used to explain the prevention of relatively large particles from becoming trapped inside the fluidized bed chambers, which is the primary objective of the present invention.

In FIG. 3, the powder raw material A, including powder ore or partially pre-reduced powder ore, is introduced into the first fluidized bed chamber 20*a* from inlet 18. The raw material A forms a fluidized bed 24*a* inside the fluidized bed chamber 20*a* with the up-flow of reducing gas introduced from the gas inlet line 21*a* at the bottom of fluidized bed chamber 20*a* via gas dispersion plate 19*a*. The gas is exhausted upwards from the fluidized bed 24*a* and exits the fluidized bed chamber from gas outlet 28. All the fluidized bed chambers (20*a*, 20*b*, 20*c*) are inter-connected by connection passages (25*a*, 25*b*), and the fluidized bed 24*a* of raw material A in the position near the connection passage 25*a* moves through this connection passage to the next fluidized bed chamber 20*b* whilst maintaining its fluidized state. A fluidized bed 24*b* is also formed inside fluidized bed chamber 20*b* in the same way through the reducing gas introduced from gas inlet line 21*b* via gas dispersion plate 19*b*, and this fluidized bed 24*b* moves through connection passage 25*b* to the next fluidized bed chamber 20*c*, wherein fluidized bed 24*c* is formed through the reducing gas introduced from gas inlet line 21*c* via gas dispersion plate 19*c*. Thereafter, the reduced powder B is removed via outlet 26.

Since, in contrast to the conventional techniques, the connection passages (25*a*, 25*b*) connecting the fluidized bed chambers (20*a*, 20*b*, 20*c*) are provided at a position deeper than the surface of the fluidized beds (24*a*, 24*b*, 24*c*), the relatively large particles which tend to reside at the bottom of the fluidized bed are preferentially moved to the next fluidized bed chamber, and there is thus no occurrence of large particles being continually trapped in a single fluidized bed chamber. Furthermore, with this kind of movement, the probability of the relatively large particles coming into contact with each other in the fluidized bed is increased, whereby the size of the powder particles may gradually become smaller. Reduction in the size of the powder particles due to the movement means that there is less and less chance of the particles becoming trapped, with the result that problems such as an increase in load on a specific fluidized bed chamber (in particular the first fluidized bed chamber for which the chances of particles becoming trapped may be considered to be the highest) or a deterioration in the flow of the reducing gas tend not to occur. The effect increases the deeper the position of the connecting passage from the surface of the fluidized bed, and the most suitable position is in the vicinity of the very bottom of the fluidized bed.

Figure 1A:
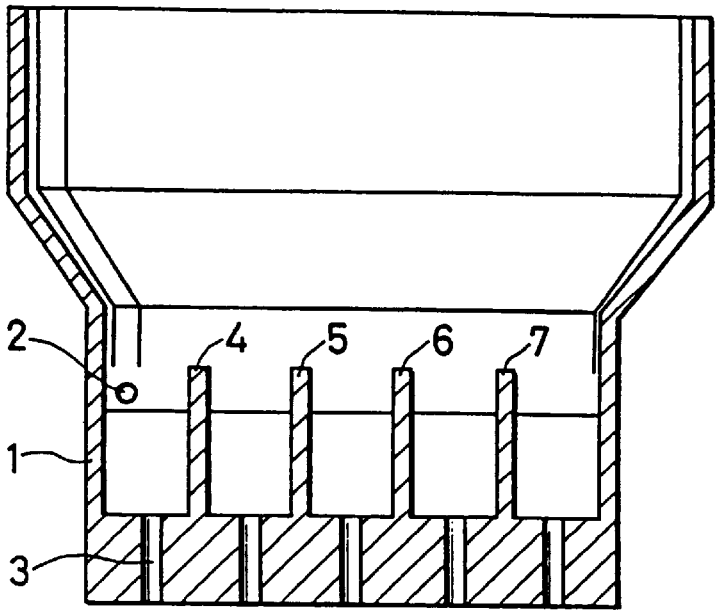
FIG. 1A (PRIOR ART)
FIG. 1A is a vertical cross-sectional view.
Figure 1B:
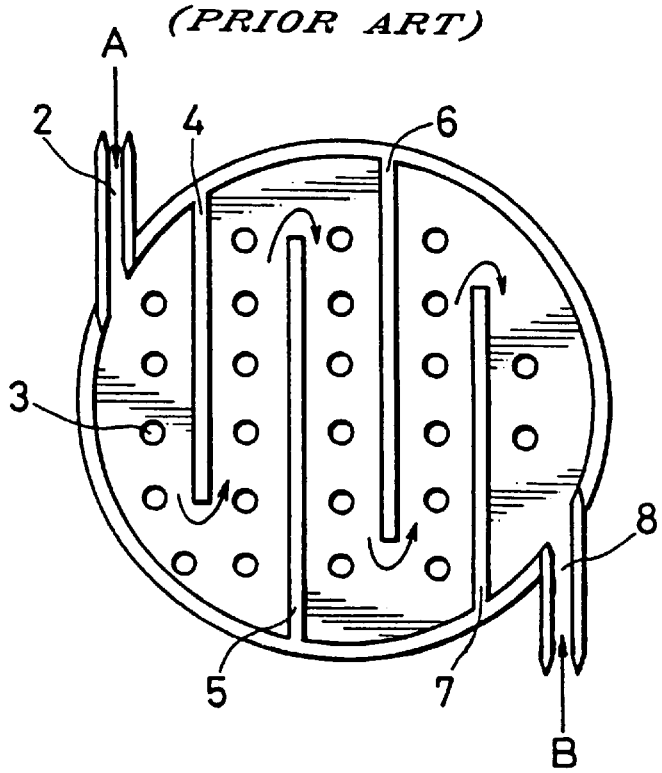
FIG. 1B (PRIOR ART)
FIG. 1B is a horizontal cross-sectional view.
Figure 2:
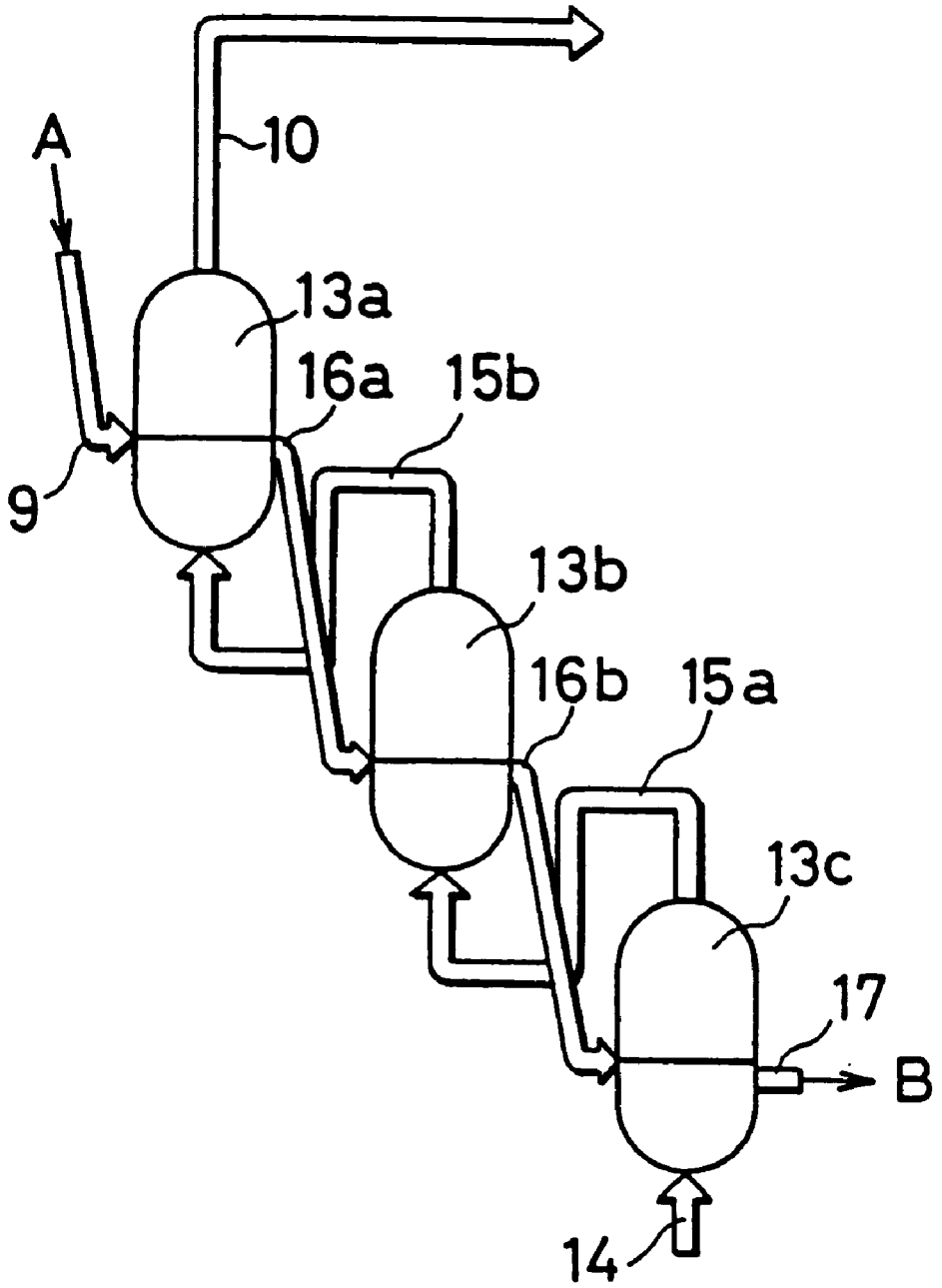
FIG. 2 (PRIOR ART)
FIG. 2 is a generalized view of a conventional fluidized bed reduction method employing a plurality of fluidized bed chambers.

Next, we shall provide an explanation regarding the increase of the degree of reduction of the powder raw material, which is another objective of the present invention. With the present invention, it is possible to introduce the reducing gas into each of the fluidized bed chambers in parallel as shown in FIG. 3. Accordingly, in contrast to the type of system shown in FIG. 2 in which the flow of the gas is in series, the reducing power of the reducing gas in each of the fluidized bed chambers is the same. This means that the reducing power in each and every one of the fluidized bed chambers will be of the same degree as that of the very last fluidized bed chamber 13*c* of the kind of system shown in FIG. 2. Accordingly, if the same number of fluidized bed chambers are employed, then the reducing power of the present invention can be increased compared to the type of system shown in FIG. 2. In other words, the present invention requires a fewer number of fluidized bed chambers in order to reduce the powder raw material to the same degree. From the point of view of the efficiency of the use of the reducing gas, it is possible that the present invention may be not as good as the prior art, since it could occur that reducing gas whose reducing power is still at a sufficient level is expelled out of the fluidized bed chamber. However, if the reducing gas which has been used in the present invention, i.e. the reducing gas exhausted from the top of the fluidized bed, is introduced into a separately provided pre-reduction furnace, then even if the efficiency of use of the reducing gas in the fluidized bed reduction reactor of the present invention might be low, it is possible to raise the efficiency of use of the reducing gas for the fluidized bed reduction system as a whole, and it is thus preferred that such a construction be adopted when carrying out the present invention.

Figure 5:
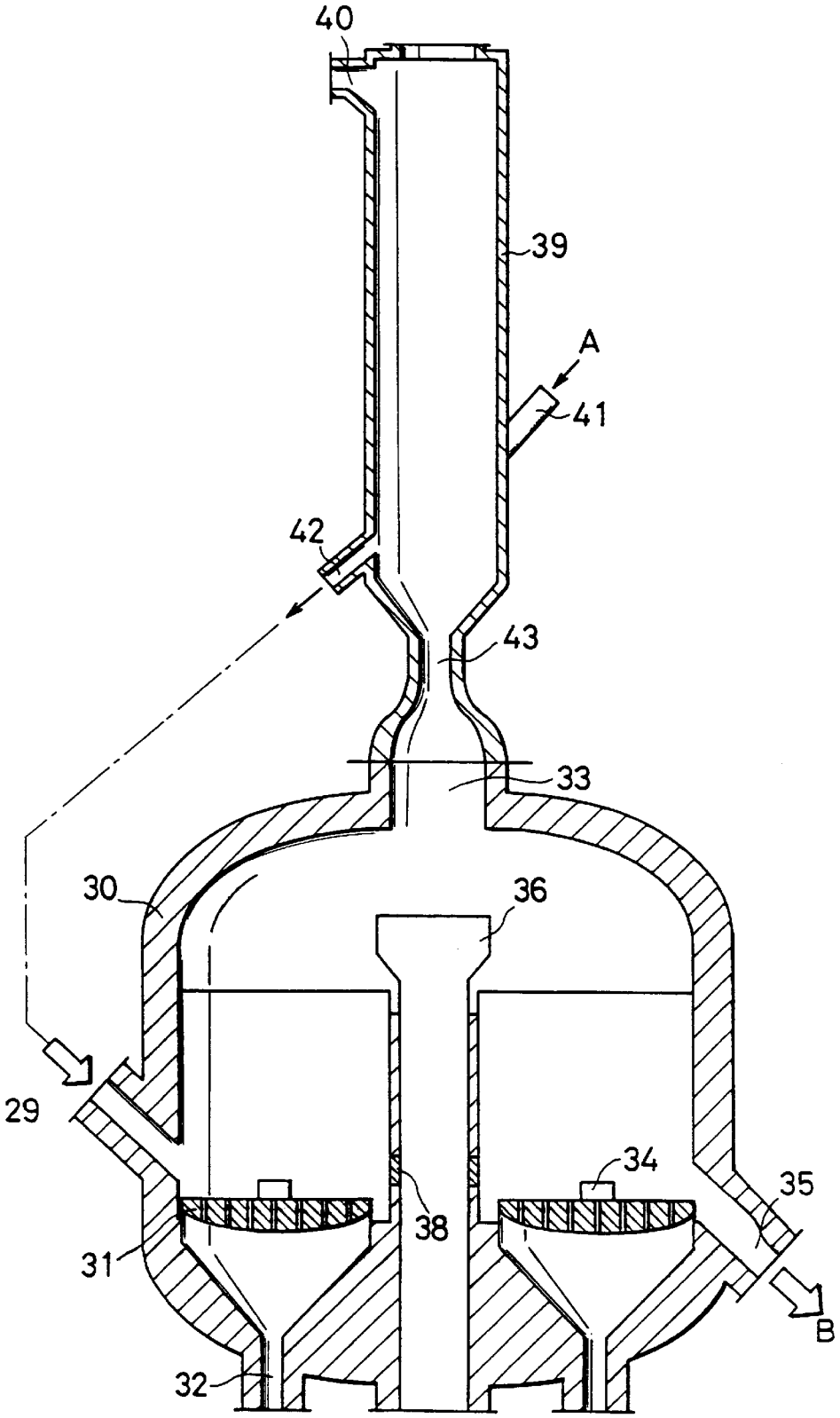
FIG. 5 is a generalized view of an example of the fluidized bed reduction system of the present invention in which a pre-reduction furnace is provided together with the fluidized bed reduction reactor of the present invention.

When a pre-reduction furnace is provided in this manner, it is necessary that the section at the top of the fluidized bed chambers from which the reducing gas is exhausted is connected to the gas inlet of the pre-reduction furnace, and that a raw material feed pipe for introducing the powder raw materials pre-reduced in the pre-reduction furnace to the most upstream fluidized bed chamber of the fluidized bed reduction reactor of the present invention be provided. As shown in FIG. 5, discussed later, it is preferred that the pre-reduction furnace be provided above the fluidized bed reduction reactor of the present invention. By doing so, it is possible to make the above-described gas inlet pipes and raw material feed pipes very short, and thus make the system as a whole compact.

Furthermore, as shown in FIG. 3, valves (22*a*, 22*b*, 22*c*) can, if required, be provided for controlling the amount of reducing gas introduced into the fluidized bed chambers to make it possible to adjust the flow rate of reducing gas for each fluidized bed chamber independently. By doing so, the reducing power can be adjusted for each fluidized bed chamber. Alternatively, it is also possible to control the reducing power of each fluidized bed chamber by independently controlling the gas composition. In these cases, mechanisms which sample and check the raw materials from each fluidized bed chamber can be provided. With the kind of system shown in FIG. 2 in which the passage of the reducing gas is in series, this kind of adjustment is impossible. However, when carrying out the present invention, it is also possible to adopt a construction in which the fluidized bed chambers are divided into several groups, wherein the flow of reducing gas in each group is conducted according to the kind of counter-flow system shown in FIG. 2.

Furthermore, in addition to this adjustment, the pressure in the space formed above each fluidized bed inside each fluidized bed chamber can also be adjusted. By appropriately adjusting the pressure of this space, the height of the surface of the fluidized bed can be changed. If the height of the surface fluidized bed is changed, the state of the distribution etc. of the powder inside the fluidized bed changes, and the reducing power of the fluidized bed changes. Accordingly, by carrying out the adjustment of the pressure in the space whilst also carrying out the adjustment of the flow rate of the reducing gas, it becomes possible to very effectively adjust the reducing power for each fluidized chamber. The adjustment of the pressure of the space may be carried out by a method in which a pressure sensor and pressure valve are operated in tandem in each fluidized chamber; or, if it is desired that the pressure in a plurality of fluidized chambers be kept at a constant level, it may be carried out using a system wherein means such as a pipe connects the spaces of the fluidized chambers. In FIG. 3, pipes (27*a*, 27*b*) connecting the spaces above the fluidized beds (24*a*, 24*b*, 24*c*) formed in fluidized bed chambers (20*a*, 20*b*, 20*c*) are provided and used for adjusting the pressure of the spaces and for expelling gas. Alternatively, as shown in FIG. 4, which is discussed later, it is also possible to keep the pressure in the plurality of fluidized bed chambers at a constant level by leaving the upper parts of the fluidized bed chambers open, surrounding the fluidized bed chambers with a separate container and adjusting the pressure inside the container.

Next, there shall be provided an explanation regarding the reduction of the effects of decreases in pressure-resistance and airtightness and deformation of the reduction reactor due to thermal expansion, which is another objective of the present invention. The method of inhibiting the effects of pressure-resistance/airtightness and the above-described deformation by giving each fluidized bed chamber a cylindrical or spherical shape is known in the prior art. By adopting a cylindrical or spherical shape, a uniformity of temperature in the radial direction in each fluidized bed chamber is ensured, making it possible to prevent localized thermal expansion and deformation of the metal components. In the present invention too, it is preferred that the fluidized bed chambers be given a shape which reduces as much as possible the tendency of the effects of thermal expansion to appear, and it is thus preferred that the fluidized bed chambers have a horizontal cross-section which is either generally circular or generally triangular in shape.

Figure 4A:
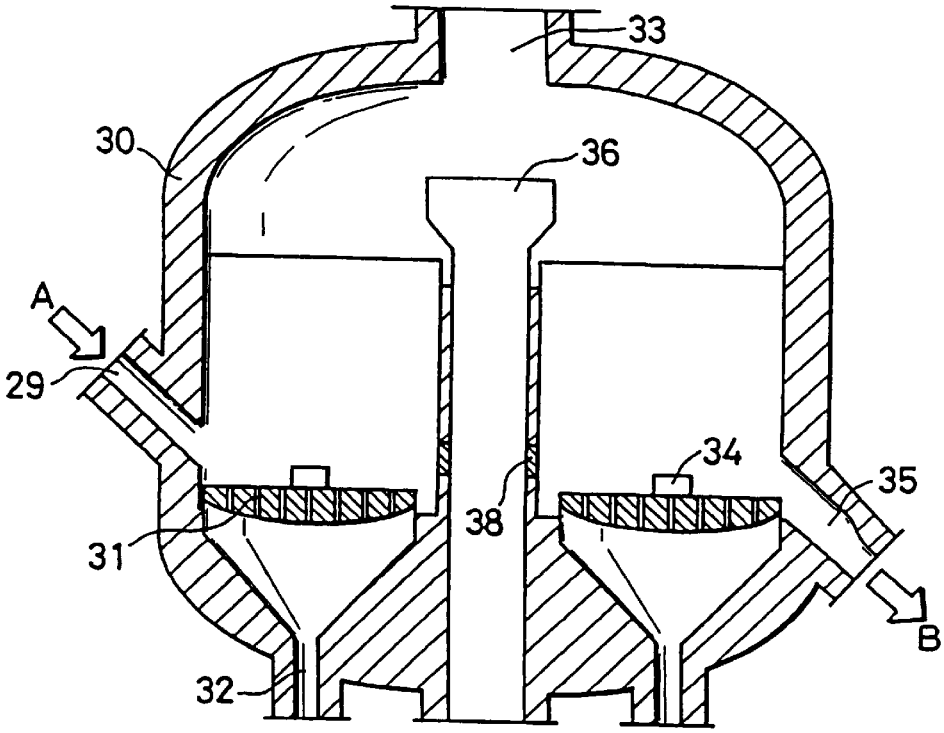
FIG. 4 is a generalized view of another example of the fluidized bed reduction reactor of the present invention.
Figure 4B:
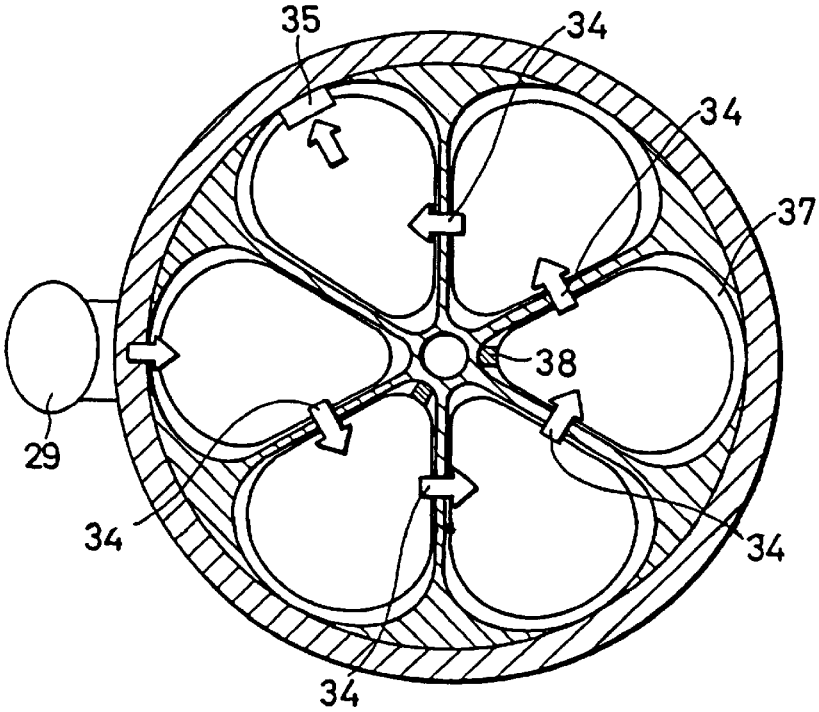

Furthermore, it is preferred that the fluidized bed chambers be arranged circularly in a horizontal plane as shown in FIG. 4. In FIG. 4, the powder raw material A introduced into the first chamber from inlet 29 moves through connection passages 34 and is finally expelled from the outlet 35 provided in the last fluidized bed chamber whilst forming a fluidized bed inside the fluidized bed chambers with the up flow of reducing gas introduced from gas inlet lines 32 via gas dispersion plates 31, as in the kind of system shown in FIG. 3. The top of the fluidized bed chambers is left open and is covered by a container 30. The gas expelled from the fluidized bed chambers is expelled (from the container) via gas outlet 33.

By adopting such an arrangement, a uniformity of temperature in the radial direction in the reduction reactor as a whole is ensured, making it possible to reduce the danger of deformation and reductions in pressure-resistance/airtightness even in those sections such as the connection passages which are prone to the effects of localized thermal expansion. When the fluidized chambers are arranged in a circle, it is considered that the ideal number of reactors for effectively exploiting the area of the reactor is about 6. Furthermore, the employment of gas dispersion plates 19 having a spherical surface shape, as shown in FIG. 4, is preferred from the point of view of pressure-resistance/airtightness.

Next, there shall be provided an explanation with respect to the possibility to effectively withdraw the reduced material from the reactor when it has attained the prescribed degree of reduction, which is another objective of the present invention. As explained above, with the present invention, the reducing power in each fluidized bed chamber can be increased, and it is therefore possible, depending on the actual operating conditions, that the raw material could attain the prescribed degree of the reduction in the course of its passage through the fluidized bed chambers before reaching the last of all the fluidized bed chambers provided. In such a case it would be inefficient in terms of time and operation to always move material which has already been reduced to the prescribed degree all the way through to the last fluidized bed chamber. The operating efficiency can be raised by providing an openable and closeable outlet in a plurality of fluidized bed chambers to make it possible to appropriately withdraw the material in accordance with the degree of reduction. However, it is an actual fact that a certain amount of total fluidization time is required at the time of reduction, and considering the fact that the reactor has a construction in which the raw material moves through a plurality of fluidized bed chambers, the necessity to provide an outlet in the fluidized bed chamber in which the inlet is provided is therefore small. The provision of a plurality of outlets in this way also becomes useful in cases where the equipment has stopped due to some kind of trouble and the raw material in the process of being reduced inside the fluidized chambers needs to be taken out by, for example, a mechanical method. In the case that the fluidized chambers are arranged in a circle, these kinds of outlets can be provided facing towards the exterior of the circle. However, as shown in FIG. 4, it is also possible to provide a vertical space 36 in the center of the circle of the fluidized bed chambers, and have the openable and closeable outlets 38 facing towards this vertical space 36. This kind of arrangement is preferred if it is desired that the reduction reactor as a whole be compact. If this kind of construction is adopted, then even if there is the occurrence, in the case that the pre-reduction furnace 39 is provided above the reduction reactor, of powder raw material suddenly falling from the pre-reduction furnace due to some accident, the fluidized bed chambers can be protected from the impact of the falling material since the falling powder raw material can be expelled through the exhaust section of the above-described vertical space 36. Furthermore, in the case that the vertical space 36 is used as an exhaust for material falling from the pre-reduction furnace 39, it is also possible not to provide a gas dispersion plate in the gas inlet 43 of the pre-reduction furnace. It is also the case for the pre-reduction furnace 39 that relatively large powder raw material tends to sink to the bottom of the fluidized bed as described earlier. In particular, the possibility that relatively large powder particles are included in the powder raw material fed to the pre-reduction furnace is high, and if a gas dispersion plate is provided it may occur that these relatively large particles become trapped on the gas dispersion plate, with the result that the flow of reducing gas in the pre-reduction furnace could be deteriorated. By eliminating the gas dispersion plate, the relatively large powder raw material that would have been trapped in the pre-reduction furnace 39 is not retained in the pre-reduction furnace 39 but falls through the vertical space making it possible to stabilize the reduction rate of the pre-reduction furnace 39. In addition, it is preferred that the outlet 42 for removing reduced material from the pre-reduction furnace be provided in a position corresponding to a deep section of the fluidized bed inside the pre-reduction furnace 39. The pre-reduced ore removed via the outlet 42 is supplied to the powder raw material inlet 29 of the fluidized bed reduction reactor as shown by the dotted broken line in FIG. 5. In FIG. 5, inlet 41 is provided for feeding powder raw material A into pre-reduction furnace 39, and gas outlet 40 is provided for expelling used gas from the pre-reduction furnace.

Cold test apparatus of the kind shown in FIG. 3 was prepared, and a test was carried out to establish whether or not the fluidized ore was moved between fluidized bed chambers and finally exhausted from the reactor without any occurrence of the fluidized ore becoming trapped. Three cylindrical vertical fluidized bed chambers having an internal diameter of 100 mm and a height of 2000 mm were arranged in a line side by side. Gas inlet lines are provided at the bottom of the fluidized bed chambers. Air is fired from the gas inlet lines into the fluidized bed chamber via a gas dispersion plate in order to fluidize powdered iron ore. The air is introduced into each fluidized bed chamber separately via the dispersion plate of each reactor, and the flow rate is adjusted for each fluidized bed chamber using adjustment valves and flow meters. The powdered iron ore is fed at a fixed rate from the inlet into the first fluidized bed chamber. Connection passages (W×H×L: 20 mm×30 mm×20 mm) are provided in the walls of the fluidized chambers at positions deep in the fluidized bed so that the fluidized powder ore can move sequentially to the next fluidized bed chamber. An outlet is provided in the last fluidized bed chamber in order to take the fluidized powder ore out of the system. The upper parts of each fluidized bed chamber are connected by a pipe so that the pressure in the space formed above the fluidized bed in each fluidized bed chamber is constant. Powdered iron ore whose grain size had been adjusted to 100–300$\mu$m was used. The blowing in of the air was adjusted, whilst observing the state of fluidization, to obtain a flow velocity inside the fluidized bed chambers in the range of 0.25 to 0.5 m/s.

In this experiment, the same amount of air was introduced into each of the three fluidized bed chambers to achieve a fluidized state, with the result that it was observed that even upon continuous introduction of the powder ore at a fixed rate, the amount of ore expelled was the same as the amount introduced without any change in the height of the surface of the fluidized bed in each fluidized bed chamber. The movement of the powder ore between the fluidized chambers was excellent and there was no occurrence of trapping. It is thus clear that, with the system of the present invention in which connection passages are provided in the walls of the fluidized bed chambers at a position deep in the fluidized bed, the powder ore can be moved smoothly between the fluidized chambers without any occurrence of the ore becoming trapped. Furthermore, the same kind of result was obtained even after reducing the height of the connection passages to 15 mm, thereby confirming that the size of the connection passages may be reduced in order to reduce the effects of counter-mixing which is the phenomenon of the powder ore moving in the opposite direction (i.e. from the outlet towards the inlet).

As described above, the present invention provides a fluidized bed reduction method with which the effects of relatively large powder ore particles becoming trapped inside the fluidized bed chambers are small, and a fluidized bed reduction reactor which can be used in the same method. The present invention also provides a fluidized bed reduction method with which the degree to which the powder raw material may be reduced may be increased, and a fluidized bed reduction reactor which can be used in the same method. Furthermore, with the present invention, the effects of reductions in pressure resistance/airtightness and deformation of the reduction reactor due to thermal expansion can be reduced. It is also possible with the present invention to efficiently remove reduced powder material from the reactor when it has attained the prescribed degree of reduction.

What is claimed is:

1. A fluidized bed reduction method comprising the steps of:

supplying reducing gas into a plurality of chambers connected with one another in a series through a plurality of supply lines connected with the plurality of chambers, respectively, each chamber being supplied with reducing gas through the corresponding supply line at a predetermined supply rate;

introducing powder raw material into a first chamber of the plurality of chambers to produce a fluidized bed of powder raw material in the first chamber owing to the supplied reducing gas;

allowing powder raw material to move from the first chamber to the subsequent chambers while producing a fluidized bed of powder raw material in each subsequent chamber, the powder raw material being moved from one chamber to next chamber at a position lower than a top of the fluidized bed formed in each chamber;

controlling the supply amount of reducing gas to each chamber in accordance with a reducing state of the powder raw material in each chamber; and discharging reduced material from at least one chamber of the plurality of chambers.

2. A fluidized bed reduction method according to claim 1, wherein the fluidized beds in the plurality of fluidized bed chambers have substantially the same height.

3. A fluidized bed reduction method according to claim 1, wherein a temperature of the fluidized beds is 700° C. or more.

4. A fluidized bed reduction method according to claim 1, wherein the powder raw material is moved from one chamber to next chamber at a position near a bottom of each chamber.

5. A fluidized bed reduction method according to claim 1, further comprising the step of controlling the pressure in a space above the produced fluidized bed in each fluidized bed chamber while controlling the supply amount of reducing gas.

6. A fluidized bed reduction method according to claim 1, wherein the chambers are arranged in a circle in a horizontal plane.

7. A fluidized bed reduction method according to claim 1, wherein the step of discharging reduced material comprises discharging from at least two of the fluidized bed chambers including the last chamber so as to remove a part or all of the raw powder material which have been reduced to a predetermined degree.

8. A fluidized bed reduction method according to claim 1, further comprising the step of directing reducing gas exhausted from chambers to powder raw material to be introduced to the first chamber.

9. A fluidized bed reduction reactor comprising:

a plurality of fluidized bed chambers connected with one another in a series, and having at least a first fluidized bed chamber and a last fluidized bed chamber, a space of one fluidized bed chamber being communicated with a space of next fluidized bed chamber at a position lower than a top of a fluidized bed formed in each of the fluidized bed chambers, a plurality of reducing gas supply lines respectively connected with the plurality of fluidized bed chambers for each supplying reducing gas to the corresponding fluidized bed chamber, each reducing gas supply line being provided with a supply controller for controlling the supply amount of reducing gas to the corresponding fluidized bed chamber;

an inlet for introducing a powder raw material in the first fluidized bed chamber, and an outlet for removing the powder raw material reduced in the fluidized beds provided in the last fluidized bed chamber.

10. A fluidized bed reduction reactor according to claim 9, wherein the position communicating between the space of one chamber and the space of the next chamber is formed near a bottom of each fluidized bed chamber wall.

11. A fluidized bed reduction reactor according to claim 9, wherein the supply controller comprises a valve for adjusting the supplying amount of the reducing gas, the valve being provided in each gas supply line.

12. A fluidized bed reduction reactor according to claim 11, further comprising a gas exhaust line connected to the upper part of each fluidized bed chamber, and means for controlling pressure in the space above each fluidized bed provided in the gas exhaust line.

13. A fluidized bed reduction rector according to claim 9, wherein each fluidized bed chamber has a cross-section which is generally circular or generally triangular in shape.

14. A fluidized bed reduction reactor according to claim 9, wherein the fluidized bed chambers are arranged circularly in a horizontal plane.

15. A fluidized bed reduction reactor according to claim 14, further comprising a gas dispersion plate provided between each fluidized bed chamber and the corresponding reducing gas supply line, the gas dispersion plate having an outwardly curved surface facing the gas supply line.

16. A fluidized bed reduction reactor according to claim 9, wherein the number of fluidized bed chambers is three or more, and wherein at least one of the plurality of fluidized bed chambers other than the last fluidized chambers further comprises a discharge opening for removing a part or all of the powder raw material.

17. A fluidized bed reduction system comprising:

a fluidized bed reduction reactor including:

a plurality of fluidized bed chambers connected with one another in a series, and having at least a first fluidized bed chamber and a last fluidized bed chamber, a space of one fluidized bed chamber being communicated with a space of next fluidized bed chamber at a position lower than a top of a fluidized bed formed in each of the two fluidized bed chambers, a plurality of reducing gas supply lines respectively connected with the plurality of fluidized bed chambers for each supplying reducing gas to the corresponding fluidized bed chamber, each reducing gas supply line being provided with a supply controller for controlling the supply amount of reducing gas to the corresponding fluidized bed chamber;

an inlet for introducing a powder raw material in the first fluidized bed chamber, an outlet for removing the powder raw material reduced in the fluidized beds provided in the last fluidized bed chamber;

a pre-reducing chamber which is connected with the reactor and into which the exhausted reducing gas is flowed from the reactor, the reactor chamber having;

an inlet port for receiving the powder raw material; and an outlet port for flowing the powder raw material out of the pre-reducing chamber, a connection passage between the outlet port of the pre-reducing chamber and the inlet of the reactor, whereby the powder raw material being pre-reduced by the exhausted reducing gas from the reactor.

18. A fluidized bed reduction system according to claim 17, wherein a pre-reducing chamber is provided above the fluidized bed reduction reactor.

19. A fluidized bed reduction system according to claim 18, wherein the fluidized bed chambers are arranged circularly in a horizontal plane, and further comprising a single vertical space provided at the center of the circular arrangement of the fluidized bed chambers, and an upper part of this vertical space is the reducing gas exhaust space and is connected to the gas inlet of the pre-reduction furnace.

20. A fluidized bed reduction system according to claim 17, wherein the rector further comprises a reducing gas exhaust section provided at the top of each fluidized bed chamber, the section being connected to the pre-reducing chamber.

* * * * *

UNITED STATES PATENT AND TRADEMARK OFFICE

CERTIFICATE OF CORRECTION

PATENT NO. : 6,187,076
DATED : February 13, 2001
INVENTOR(S) : Sugahara et al.

It is certified that error appears in the above-identified patent and that said Letters Patent is hereby corrected as shown below:

On the Title page, the CPA information has been omitted. It should read as follows:

--(45) **Date of Patent: *Feb. 13, 2001**--

--(*) Notice: This patent issued on a continued prosecution application filed under 37 CFR 1.53(d), and is subject to the twenty year patent term provisions of 35 U.S.C. 154(a)(2). --

Signed and Sealed this

Fifth Day of June, 2001

*Attest:*

*Attesting Officer*

Nicholas P. Godici

NICHOLAS P. GODICI

*Acting Director of the United States Patent and Trademark Office*